United States Patent [19]

Sakamaki et al.

[11] 3,930,899

[45] Jan. 6, 1976

[54] METHOD OF SPRAYING MOLYBDENUM ON ALUMINUM OR ALUMINUM ALLOY

[75] Inventors: Hiroshi Sakamaki, Utsunomiya; Shohei Ishikawa, Omiya; Toshiyuki Maeda, Ageo, all of Japan

[73] Assignee: Nippon Piston Ring Co., Ltd., Tokyo, Japan

[22] Filed: Dec. 5, 1973

[21] Appl. No.: 421,908

[30] Foreign Application Priority Data

Dec. 6, 1972 Japan ..... 47-121647

[52] U.S. Cl. ..... 148/6.27; 29/197; 29/198; 427/406; 427/422

[51] Int. Cl.[2] ..... C23C 7/00

[58] Field of Search ..... 117/71 M, 114 A, 50, 105; 427/405, 406, 422; 29/198, 197; 148/6.27

[56] References Cited

UNITED STATES PATENTS

| | | | |
|---|---|---|---|
| 2,662,831 | 12/1953 | Culverhouse, Jr. | 117/50 |
| 2,676,916 | 4/1954 | Zelley | 117/50 |
| 3,148,086 | 9/1964 | Seibert | 117/105 |
| 3,180,715 | 4/1965 | Simon | 117/71 M |
| 3,202,529 | 8/1965 | Dunlap, Jr. et al. | 117/71 M |

*Primary Examiner*—Cameron K. Weiffenbach
*Assistant Examiner*—Charles R. Wolfe, Jr.
*Attorney, Agent, or Firm*—Sughrue, Rothwell, Mion, Zinn & Macpeak

[57] ABSTRACT

Herein disclosed is a metal spraying method, which comprises the steps of subjecting the surface of aluminum or aluminum alloy to zinc-substitution treatment so as to form a zinc layer in said surface, and spraying a desired metal directly on the substituted zinc layer or on a metal layer, which is formed by preliminarily spraying such a metal as has sufficient adhesion to said desired metal, so as to form thereon a metal sprayed layer.

4 Claims, No Drawings

METHOD OF SPRAYING MOLYBDENUM ON ALUMINUM OR ALUMINUM ALLOY

BACKGROUND OF THE INVENTION

1. Field of the Invention

The present invention relates to an improvement in a metal spraying method, i.e., spraying a desired metal on the surface of aluminum or aluminum alloy (both of which will be hereinafter referred to as an "aluminum material").

2. Description of the Prior Art

A variety of metal sprayings onto the surface of an aluminum material have been widely put into practice for various purposes. Since, however, aluminum is subject to the formation of an oxide layer on its surface, a sufficient adhesion between the metal-sprayed layer and the aluminum substrate cannot be obtained due to the existence of this oxide layer. As a result, the metal-sprayed layer will be susceptible to being peeled off, and as such little can be expected from the spraying of a layer onto the aluminum material.

In the current metal spraying method, which is widely employed in the art in order to improve the particular adhesive, effects a thin foundation coat is first created by spraying onto the aluminum material a highly adhesive metal such as nickel aluminide or molybdenum. Then, desired metal is sprayed onto the thin foundation coat, thus ensuring a considerably secure adhesion inbetween. In this conventional method, however, the metal spraying is performed on the aluminum material through its oxide layer, and the aforementioned difficulty due to the existence of the oxide layer is not solved. This is especially so when the metal-sprayed aluminum material is to be used in such sealing elements of an internal combustion engine as are exposed to severe working conditions under the circumstance the peeling-off of the sprayed metal layer from the substrate cannot be prevented in the least. Thus, the current metal spraying method can afford a satisfactory answer.

SUMMARY OF THE INVENTION

It is, therefore, a major object of the present invention to provide a novel metal spraying method involving the spraying of a desired metal onto the surface of an aluminum material, but wherein sufficient adhesion between the sprayed metal layer and the aluminum substrate is obtainable without the undesirable peeling-off of the former after a prolonged period of time even when the products obtained according to the invention are used under severe working conditions.

According to an important feature of the present invention, there is provided a metal spraying method which comprises the steps of subjecting the surface of an aluminum material to a zinc-substitution treatment so as to form a zinc layer in said surface, and then spraying a desired metal on the substituted zinc layer so as to form thereon a metal sprayed layer.

DESCRIPTION OF THE PREFERRED EMBODIMENTS

When, in the present invention, the zinc-substitution treatment is carried out, the oxide layer, if any on the aluminum surface, is substituted for a thin zinc layer. This zinc layer has a satisfactory adhesion to the aluminum substrate. When, moreover, a desired metal is then sprayed onto the substituted zinc layer, the zinc content will be melted into the resultant metal layer. This is because zinc ordinarily has a lower melting point than the metal to be sprayed thereon. Thus, the sprayed metal layer cana be bonded directly to the surface of the aluminum material without there being any oxide layer. As a result, the sprayed metal layer can have significantly higher adhesion to the aluminum material than in prior art processes.

In one embodiment, after a preliminary metal having high adhesion has been thinly sprayed onto the thin zinc-substituted layer, a desired metal can then be sprayed onto this preliminary metal layer. From this embodiment, an aluminum product formed with a sprayed metal layer securedly adhered to the aluminum substrate can also be obtained.

As has been described by the above, according to the present invention, an aluminum product formed with a sprayed metal layer having a remarkably strong adhesion can be obtained without resorting to a complicated process. The aluminum product thus manufacutured can be used for a prolonged time period without being subject to undesirable peeling-off, even if it is used as a sealing element of an internal combustion engine which will be exposed to severe working conditions. Thus, the present invention should be appreciated in that it can contribute greatly to the relevant industry.

The metal spraying method of the present invention will become more apparent from the following Example:

EXAMPLE

A test piece having dimensions of 20 × 20 × 50 mm and a roughness of 50 S was fabricated of an aluminum material of JIS (Japanese Industrial Standard) No. 2024. The test piece thus fabricated was then treated to have its surface alkaline-degreased in the mixture of 25 g/l of sodium carbonate and 25 g/l of sodium tertiary phosphate at a temperature lower than 70° for 2 minutes. After washing in water, the alkaline-degreased test piece was pickled for about 5 seconds in a mixture solution containing one part of hydrofluoric acid and three parts of nitric acid. After that, the test piece thus pickled was rapidly washed again in water. Then, the test piece was subjected for about 50 seconds to zinc substitution in the zinc-substituting solution which contains 525 g/l of caustic soda, 100 g/l of zinc oxide, 1 g/l of crystaline ferric chloride and 10 g/l of potassium sodium tartrate. As a result of this treatment, the oxide layer on the aluminum material was cleaned off and replaced by a thin layer of zinc. At the final stage, molybdenum was sprayed onto the thin zinc layer to form a sprayed molybdenum layer of 0.3 mm thickness.

For comparative purposes, a test piece of the same material having the same dimensions was fabricated separately from the former test piece. The roughness of the latter was also set at 50 S. The surface of the latter to be sprayed was preliminarily subjected to spraying treatment of nickel aluminide to form a nickel aluminide layer having 0.07 thickness. Then, molybdenum was sprayed onto the nickel aluminide layer to form a conventional test piece having a molybdenum layer of 0.3 mm thickness.

The adhesion test was carried out four times for the two test pieces. The test was carried out by measuring the tensile strength of the adhered portion, and the adhesive used was of $\alpha$ — cyano acrylate type.

The test results for the conventional test piece showed that all the sprayed surfaces were peeled off by the tensile test, and the measured tensile strengths were 155.5 Kg/cm, 210.0 Kg/cm, 158.0 Kg/cm and 269.8 Kg/cm, with the resultant mean tensile strength being 193.35 Kg/cm.

The test results for the test piece of the invention, on the other hand, showed that none of the sprayed surfaces were easily peeled off. The tests were continued, however, until the adhered surfaces were eventually peeled off. The tensile strengths, which were measured at the instant when the peeling-off of the adhered surfaces took place, were 425.0 Kg/cm, 466.3 Kg/cm, 392.5 Kg/cm and 457.5 Kg/cm, and their mean value was 435.5 Kg/cm. Although from these tests a specific figure could not be obtained as to how strong the adhesion of the sprayed layer of the invention to the aluminum substrate was, it can be estimated roughly to be at least the mean value of 435.3 Kg/cm. This value means that the adhesion according to the present invention is at least 2.2 times stronger than that of the conventional type.

As will be easily understood from the foregoing, the present invention should be highly appreciated as an excellent and novel method for metal-spraying of aluminum or aluminum alloy.

What is claimed is:

1. A method of spraying a molybdenum layer onto an aluminum or aluminum alloy surface having enhanced adhesion thereto comprising a. subjecting the surface to a zinc-substitution treatment to form a zinc layer in said surface, and b. spraying the molybdenum onto the substituted zinc layer to form the molybdenum layer, the aluminum or aluminum alloy not being heated prior to step (b), such that the zinc from the zinc-substituted layer melts into the sprayed molybdenum layer.

2. A method of spraying a molybdenum layer onto an aluminum or aluminum alloy surface having enhanced adhesion thereto comprising a. subjecting the surface to a zinc-substitution treatment to form a zinc layer in said surface, b. preliminarily spraying nickel aluminide onto the substituted zinc layer between steps (a) and (b) which has a high adhesion to the zinc layer, and c. spraying the molybdenum onto the preliminarily sprayed nickel aluminide layer of (b) to form the molybdenum layer, the aluminum or aluminum alloy not being heated prior to step (c), such that the zinc from the zinc-substituted layer melts into the sprayed nickel aluminide-molybdenum layer.

3. A sealing element produced by the method of claim 1.

4. A sealing element produced by the method of claim 2.

* * * * *